US007431817B2

(12) United States Patent
Hradil et al.

(10) Patent No.: US 7,431,817 B2
(45) Date of Patent: Oct. 7, 2008

(54) ELECTROPLATING SOLUTION FOR GOLD-TIN EUTECTIC ALLOY

(75) Inventors: Hana Hradil, Bradendon, FL (US); George Hradil, North Scituate, RI (US); Edward Hradil, Bradendon, FL (US)

(73) Assignee: Technic, Inc., Cranston, RI (US)

( * ) Notice: Subject to any disclaimer, the term of this patent is extended or adjusted under 35 U.S.C. 154(b) by 0 days.

(21) Appl. No.: 11/126,954

(22) Filed: May 10, 2005

(65) Prior Publication Data

US 2005/0252783 A1 Nov. 17, 2005

Related U.S. Application Data

(60) Provisional application No. 60/570,510, filed on May 11, 2004.

(51) Int. Cl.
*C25D 3/60* (2006.01)
*C25D 3/62* (2006.01)
*C25D 5/02* (2006.01)

(52) U.S. Cl. ..... 205/247; 205/248; 205/249; 205/252; 205/253; 205/118; 205/123

(58) Field of Classification Search ..... 205/247, 205/248, 249, 252, 253, 118, 123
See application file for complete search history.

(56) References Cited

U.S. PATENT DOCUMENTS

| | | | | |
|---|---|---|---|---|
| 3,035,991 | A | 5/1962 | Strauss et al. | 204/51 |
| 3,764,489 | A * | 10/1973 | Zuntini et al. | 205/247 |
| 4,012,294 | A | 3/1977 | Losi et al. | 204/43 |
| 4,013,523 | A * | 3/1977 | Stevens et al. | 205/247 |
| 4,179,344 | A * | 12/1979 | Thomson | 205/242 |
| 4,366,035 | A | 12/1982 | Wilkinson | 204/44 |
| 4,391,679 | A | 7/1983 | Zilske et al. | 204/43 G |
| 4,487,664 | A * | 12/1984 | Dorbath et al. | 205/247 |
| 4,634,505 | A * | 1/1987 | Kuhn et al. | 205/247 |
| 4,980,035 | A * | 12/1990 | Emmenegger | 205/238 |
| 5,308,464 | A | 5/1994 | Murphy et al. | 204/222 |
| 6,245,208 | B1 * | 6/2001 | Ivey et al. | 205/248 |
| 6,544,398 | B2 * | 4/2003 | Uchida et al. | 205/247 |
| 2002/0063063 | A1 | 5/2002 | Uchida et al. | 205/247 |
| 2004/0231999 | A1 | 11/2004 | Morrissey | 205/247 |

FOREIGN PATENT DOCUMENTS

| | | | |
|---|---|---|---|
| DE | 4406434 | | 8/1995 |
| DE | 4406434 C1 | * | 8/1995 |
| FR | 1 566 760 | | 5/1969 |
| GB | 2034756 A | | 6/1980 |
| JP | 55107795 A | * | 8/1980 |
| JP | 2003193286 | | 7/2003 |

OTHER PUBLICATIONS

References A, B and N were cited on the International Search Report.*

G. Holmbom et al., XP000750586, "Electrodeposition,Growth Morphology & Melting Characteristics Of Gold-Tin Eutectic Alloys", Plating And Surface Finishing, vol. 85, No. 4, pp. 66-73 (1998), no month.

N. Kubota et al., XP008071290, "Conductivity and Ion Transport In Gold-Tin Pyrophosphate Baths", Plating And Surface Finishing, vol. 71, pp. 46-49 (1984), no month.

J. Doesburg et al., XP 001110304, "Co-Deposition Of Gold-Tin Alloys From A Non-Cyanide Solution", Plating And Surface Finishing, vol. 88, No. 4, pp. 78-83 (2001), no month.

Y. Zhang et al, XP008071032, "Electroplating Of Gold-Tin Alloys From A Sulfite-Citrate Bath", Plating And Surface Finishing, vol. 91, pp. 28-33 (2004), no month.

B. Djurfors et al., XP002406322, "Film Growth Characterization Of Pulse Electrodeposited Au/Sn Thin Films", GaAs Mantech, Inc., The International Conference On Compound Semiconductor Manufacturing Technology, (2006), no month.

* cited by examiner

*Primary Examiner*—Edna Wong
(74) *Attorney, Agent, or Firm*—Winston & Strawn LLP

(57) ABSTRACT

The invention relates to an electrolyte used in connection with the deposition of a gold-tin alloy on an electroplatable substrate. This solution generally includes water; stannous and/or stannic tin ions, a complexing agent to render the stannous and/or stannic tin ions soluble, complexed gold ions, and an alloy stabilizing agent that includes ethoxylated compounds with phosphate ester functional group, brightening additives based on ethoxylated phosphate esters and alkali metal fatty acids dipropionates. The brighteners may be used alone or in conjunction with each other to achieve beneficial synergistic effect. The alloy stabilizing agent is present in an amount sufficient to stabilize the composition of the gold-tin deposit over a usable current density range. The solution has a pH of between 2 and 10 and the gold ions and tin ions are present in relative amounts sufficient to provide a deposit having a gold content less than 90% by weight and a tin content greater than 10% by weight.

22 Claims, 1 Drawing Sheet

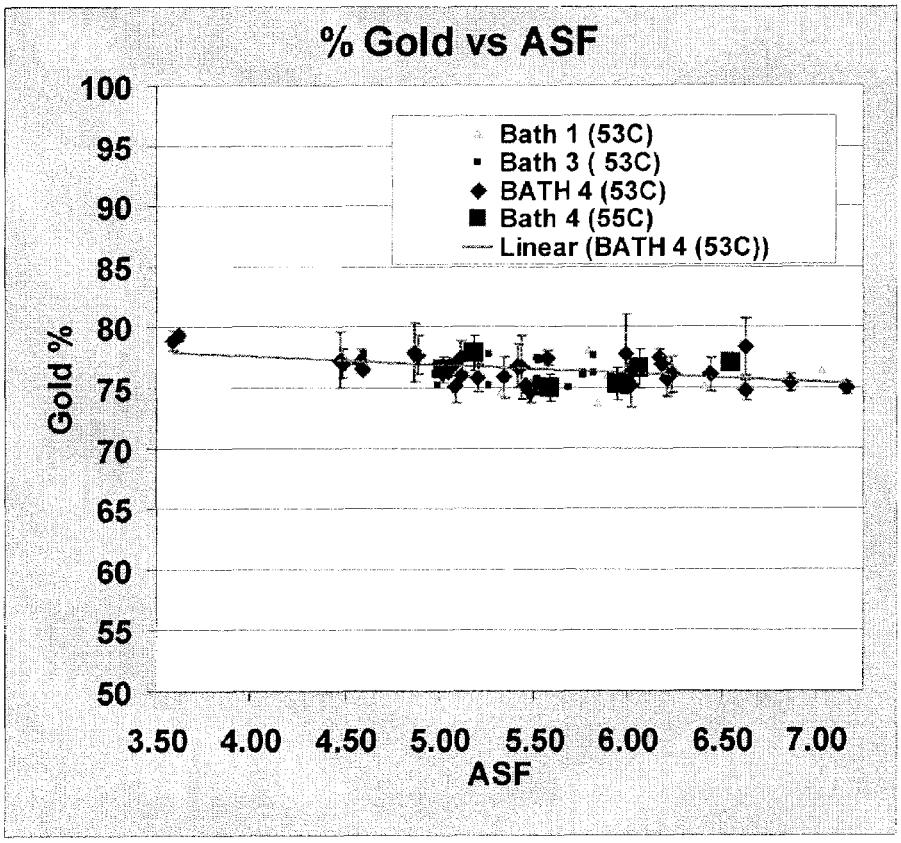
Figure 1. The solution of the examples of the present application provides a eutectic gold/tin alloy over a relatively broad current density range.

ELECTROPLATING SOLUTION FOR GOLD-TIN EUTECTIC ALLOY

CROSS-REFERENCE TO RELATED APPLICATIONS

This application claims the benefit of the U.S. provisional application 60/570,510 filed May 11, 2004, the entire content of which is expressly incorporated herein by reference thereto.

FIELD OF INVENTION

The invention describes an electrolyte for deposition of eutectic gold-tin alloy useful in many microelectronic applications including chip bonding and wafer bump plating. The use of 80-20 wt % (70-30 at atom %) eutectic gold-tin alloy is particularly desirable as a solder. At present time vacuum deposition or 80-20-wt % AuSn alloy eutectic gold-tin alloy pre-forms are the existing method for manufacture of electronic parts. However, electro-deposition, due to its low cost and versatility, is a preferred method of application.

BACKGROUND OF THE INVENTION

Electroplating baths for the deposition of gold-tin alloy have been found by the current inventors to be incapable of depositing the eutectic alloy over a usable current density range. This was clearly demonstrated in "Film growth characterization of pulse electro deposited Au/Sn tin films" by Djurfors and Ivey (GaAs MANTECH, 2001), where they show a step transition from 16 at % Sn to 50 at % at a current density of around 1.5 mA/cm$^2$. According to the authors this is a result of the deposition of two distinct phases; $Au_5Sn$ (16 at % Sn) at low current density and AuSn (50 at % Sn) at high current density. This has been further confirmed by our work which has shown that prior art electrolytes will not typically yield the desired eutectic alloy.

The prior art electrolytes, using complexing agents such as citric acid, pyrophosphate, gluconic acid, ethylene diamine tetra acetic acid ("EDTA"), and the like, typically yield alloys which are either tin rich (<50% Au) or gold rich (95% Au), or have tin rich or gold rich regions at different current densities. An 80/20 wt % eutectic gold-tin alloy cannot be deposited over a usable current density range. Moreover, many prior art baths suffer from poor stability making them of little practical interest.

U.S. Pat. No. 4,634,505 by Kuhn, et al. describes an electrolyte using trivalent gold cyanide complex and a tin IV oxalate complex, which operates at pH below 3. The formulation also uses oxalic acid as a conducting salt. However, this bath gives deposits with less than 1% Sn, and therefore it is not useful for depositing a eutectic alloy.

U.S. Pat. No. 4,013,523 by Stevens et al. describes a bath using a trivalent gold complex and tin as a stannic halide complex. The pH is less than 3 and the bath is claimed to be capable of depositing an 80-20 wt % gold alloy.

U.S patent publication 2002063063-A1 by Uchida et at. describes a non-cyanide formulation where the gold complexes include gold chloride, gold sulfite and gold thiosulfate among others. The electrolyte includes stannic and stannous salts of sulfonic acids, sulfosuccinates, chlorides, sulfates, oxides and oxalates. The tin is complexed with EDTA, DTPA, NTA, IDA, IDP, HEDTA, citric acid, tartaric acid, gluconic acid, glucoheptonic acid among others. The deposit is brightened by a cationic macromolecular surfactant. Oxalate is listed among the possible buffer compounds.

Japanese patent application 56136994 describes a solution, which uses sulfite gold complex in combination with stannous tin pyrophosphate complex at a pH of 7 to 13.

German patent DE 4406434 uses trivalent gold cyanide complex in conjunction with stannic tin complexes. The pH is 3-14 and an 80-20 eutectic alloy is reported.

U.S. Pat. No. 6,245,208 by Ivey et al. discloses a non-cyanide formulation which uses gold chloride in combination with sodium sulfite, stannous tin, a complexing agent (ammonium citrate), and uses ascorbic acid to prevent oxidation of divalent tin. Eutectic alloy deposits are claimed and bath stability on the order of weeks is reported.

As noted, the prior art electrolytes are not always stable and have been found to be ineffective in providing eutectic gold tin alloy, particularly for electroplating of small parts for electronic components or composite substrates.

Accordingly, there is a need for a stable electroplating bath for the deposition of a eutectic gold-tin alloy on various substrates, and this is now provided by the present invention.

SUMMARY OF THE INVENTION

The invention relates to an aqueous electrolyte for use in connection with the deposition of a gold-tin alloy on an electroplatable substrate. This electrolyte generally comprises a solution that includes water, complexed gold ions, tin ions, a complexing compound to render the tin ions soluble in the solution, and an alloy stabilization agent present in an amount sufficient to stabilize the alloy composition that is deposited. Advantageously, the solution has a pH of between about 2 to 10 and the gold ions and tin ions are present in relative amounts sufficient to provide a deposit having a gold content of less than about 90% by weight and a tin content greater than about 10% by weight Preferably, the gold ions and tin ions are present in relative amounts sufficient to provide a deposit having a gold content of between 75 and 85% by weight and a tin content of between 15 and 25% by weight.

The alloy stabilization agent is present in an amount sufficient to stabilize the deposited alloy and enables a eutectic gold-tin deposit to be provided over a usable current density range. The alloy stabilization agents of the current invention comprise anionic surfactants based on phosphate esters of the general formula:

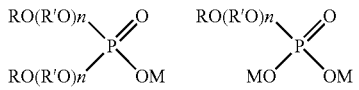

wherein R is alkyl or alkyl aryl group, n is 7 to 10 moles of ethylene and/or propylene oxide, M is hydrogen, sodium, potassium, ammonium or other counter ion, and R' is ethyl and/or propyl group.

The electrolyte of the current invention may also contain a brightening agent, which may act alone or in conjunction with the alloy stabilization agent to achieve a synergistic effect. Brightening agents include but are not limited to amphoteric imidazoline derivative having the general structural formula:

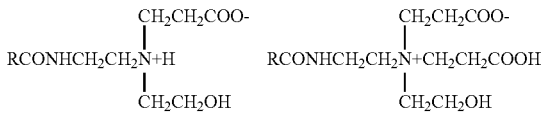

wherein R is fatty acid alkyl group and the derivative is soluble in the electrolyte. Alkali metal salts of hexacyano ferrate are not only powerful brightening agents but powerful tin antioxidants as well.

Lastly it has been found that ascorbic acid, or its alkali metal or ammonium salts, in combination with oxalic acid and its alkali metals or ammonium salts provide powerful synergistic brightening and Au—Sn eutectic alloy stabilizing effect.

The invention also relates to a method for electroplating of a eutectic gold-tin (80 wt % Au and 20 wt % Sn) alloy deposit which comprises contacting the substrate with one of the solutions disclosed herein and passing a current though the solution to provide a gold-tin alloy deposit thereon. This method is applicable for electroplating a eutectic alloy deposit on composite articles that include electroplatable and non-electroplatable portions. To do so, such articles are contacted with the solution and a current is passed though the solution to provide a gold-tin alloy electrodeposit on the electroplatable portions of the articles without deleteriously affecting the non-electroplatable portions of the articles.

DETAILED DESCRIPTION OF THE PREFERRED EMBODIMENTS

It has now been found that an alloy with a significant tin content, exemplified by the eutectic 80/20 gold-tin alloy, can be deposited over a usable range of current densities from the electrolytes disclosed herein. Thus, while alloys such as 70 at % gold—30 at % tin and 90 wt % gold—10 wt % tin are obtainable, the eutectic alloy, or as close to the eutectic alloy as possible, is preferred due to the well known advantages of such an alloy.

The source of gold ions can be mono- or tri-valent potassium or ammonium gold cyanide. In the presence of divalent tin compounds, the tri-valent gold is almost immediately reduced to mono-valent potassium, sodium or ammonium gold cyanide complex. The following equation elucidates the reduction process:

$$K[Au(CN)_4]+Sn(C_2O_4)+K_2C_2O_4=K[Au(CN)_2]+Sn(C_2O_4)_2+2KCN$$

The complexing agents for gold ions are generally organic acids or a salt thereof, with oxalic, citric, gluconic, malonic, ascorbic, iminodiacetic acid or a solution soluble salt thereof being preferred. The complexed gold ions are advantageously gold cyanide or gold sulfite complexes. Preferably, the complexed gold ions are present in amount between about 0.1 and 100 g/l.

The tin ions can be added in any soluble form which provides stannous or stannic ions. The overall tin ion concentration in the solution is generally between about 0.1 and 50 g/l although this can vary depending upon other solution components. Any di or tetravalent tin salt, including; sulfate, chloride, methane sulfonate, oxalate, or any other suitable stannous or stannic tin salt, can be used to provide these stannous or stannic ions, and the specific tin salt is not critical. Stannic tin may also be added to the solution, however, some stannous tin must be present in the electrolyte for the invention to function properly. The stannous tin ion concentration in the inventive solution is between 1 and 30 g/l and more preferably between 2 and 10 g/l. The stannic tin may be present in the inventive electrolyte between 0 g/l to 40 g/l.

The concentration of stannous ions may be adjusted in relation to the gold ion concentration to provide the desired alloy. One of ordinary skill in the art can optimize the metal concentrations in any particular solution to obtain the desired gold-tin alloy.

The complexing agent for the tin ions is present in the electrolyte to assist in rendering and maintaining the stannous and/or stannic tin ions soluble at the operational pH. Any suitable organic acid can be used for this purpose. Examples of complexing agents useful in the present invention include but are not limited to oxalic acid, citric acid, ascorbic acid, gluconic acid, malonic acid, tartaric acid and iminodiacetic acid. Solution soluble salts of these acids can also be used. Generally, carboxylic acids are preferred, but ascorbic acid, which is not a carboxylic acid, is also a preferred complexor. Moreover, any other complexing agent which can complex the stannous and/or stannic tin in the solution, can be used. The most preferred complexing agents are oxalic, citric, gluconic, heptagluconic and malonic acids and their salts. Solution soluble oxalate, citrate, tartrate, glycerate, ascorbate, gluconate, heptagluconate, malonate, iminodiacetate, nitrilotriacetate, ethylene di-amino-tetra acetate or pyrophosphate salts are also useful.

The complexing agent is present in the solution in a sufficient concentration to maintain the stannous and/or stannic tin soluble at the electrolyte's pH. It is desirable to maintain an excess of complexing agent beyond the minimum concentration to improve solution conductivity and to provide pH buffering. The complexing agent for the tin ions is generally present in the solution from about 5 g/l to about saturation. The tin ion complexor concentration is typically between 10 and 300 g/l and is most preferably between 40 and 150 g/l.

The gold ions are preferably provided in the electrolyte as a gold cyanide complex, most preferably monovalent gold cyanide, although, trivalent gold cyanide may also be used. Non-cyanide sulfite gold complex can also be used in the present invention when short life span of the electrolyte is acceptable; otherwise this complex would not be preferred as the stability of this complex is inferior to the others. The most preferred is potassium, sodium, lithium and ammonium gold cyanide complex. The preferred concentration of gold ion complex in the present invention is between 2 and 40 g/l and most preferably between 3 and 10 g/l.

It has been found that the addition of an alloy stabilization agent comprising of anionic surfactants based on phosphate esters of the general formula:

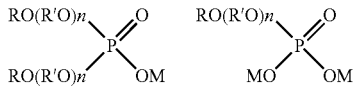

wherein R is alkyl or alkyl aryl group, n is 7 to 10 moles of ethylene and/or propylene oxide, M is hydrogen, sodium, potassium or other counter ion, and R' is ethyl and/or propyl group will produce an electrolyte which deposits the desired eutectic or similar gold-tin alloys over an acceptable range of current densities. In the absence of such an additive or additives the deposit may be either tin or gold rich or may have tin or gold rich regions in different areas caused by different current densities.

The concentration of the alloy stabilization agent in the electrolyte is in the range of 0.01 to 10 ml/l and most preferably in the range of 0.05 to 1 ml/l.

Other additives can be added to the solution to modify the grain structure of the deposit. These include metallic additives such as nickel, cobalt, arsenic, lead, thallium, or selenium. Organic additives such as those described in US patent publication 2002063063 may also be used, if desired. Brightening agents, generally comprising anionic or amphoteric surfactants, or a combination thereof, can be used if desired. In particular, it is preferred to use brightening agents of amphoteric imidazoline derivatives having the general structural formula:

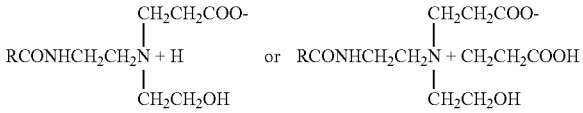

wherein R is fatty acid alkyl group as these derivatives are soluble in the electrolyte. A most preferred brightener is the anionic surfactant is poly (oxy-1,2-ethanediyl) α- tridecyl ω-hydroxy phosphate at a concentration of 0.1 to 10 grams per liter.

It has been further found that alkali metals salts of hexacyanoferrate are also very effective brightening agents in the present invention. Thus, the use of brightening agents in conjunction with the alloy stabilizing agent is in accordance with the invention. For this combination, the alloy stabilizing agent is preferably present in a concentration of about 0.1 to 10 grams per liter and the brightening agent is preferably present in a concentration of about 0.05 to 5 grams per liter.

An antioxidant is by its nature a reducing agent. The invention preferably includes an antioxidant to assist in maintaining the tin ions as stannous tin. For the purpose of illustration and not limitation, the antioxidant can include catechol, hydroquinone, ascorbic acid, hexacyanoferrate, or phenolsulfonic acid, or other agents, such as potassium ferro-hexacyanide, hydrazine, hydroxylamine, pyrogallol, tiron, cresolsulphonic acid, pyrocatechol, resorcinol, phloroglucinol, 2-aminodiphenylmethane or p-hydroxyanisole, can be used to prevent tin oxidation. The preferred antioxidant is hydroquinone. The antioxidant is present in an amount of between about 0.1 and 5 g/l of the solution, and is preferably between about 0.5 and 2 g/l.

Other salts or buffers may be optionally added to the electrolyte to improve conductivity or pH stability. Examples, of such additives include simple salts such as potassium methane sulfonic acid, potassium sulfate, as well as others that are well known in the art.

The pH of the electrolyte is between about 2 and 10, most preferably between 3 and 5.5. The preferred pH of the solution depends upon the gold complex that is used. For instance, potassium gold cyanide is not stable below a pH of 3, but a trivalent gold cyanide complex is stable at lower pH values. Sulfite gold complexes are generally not stable below pH 6 and are most stable at pH 8 and higher. Since the solution of the present invention is useful in microelectronics applications, it is desirable to have a pH of less than 8 and preferably less than 7 to prevent solution attack on photoresist masks that are often applied to the electrodeposited substrates. Additionally, it has been found that deposit appearance of eutectic tin-gold alloy begins to degrade at pH values greater than 4.7. For these reasons, the electrolytes preferably have a pH value of about 4.

The solution temperature is typically between 20 and 70° C. and is most preferably between 38 and 60° C. Temperature has a direct effect on the composition of the deposited alloy, with higher temperature resulting in higher gold contents in the deposited eutectic alloy.

The electrolyte of the present invention may be operated using insoluble anodes including platinized titanium, platinized niobium, or iridium oxide electrode. It is also possible to use soluble anodes, however, this is not typically practiced in precious metals plating.

EXAMPLES

The following examples are merely illustrative of the present invention and they should not be considered as limiting the scope of the invention in any way, as these examples and other equivalents thereof will become apparent to those skilled in the art in light of the present disclosure and the accompanying claims.

Example 1

A eutectic gold-tin alloy electrodeposit is obtained from the following electrolyte;

| | |
|---|---|
| Citric acid | 52 g/l |
| Potassium citrate | 67 g/l |
| Tin (as tin sulfate) | 3 g/l |
| Gold (as potassium gold cyanide) | 6 g/l |
| Ethoxylated phenol ester | 0.15 ml/l |
| Catechol | 1 g/l |
| pH adjusted with KOH | 4.0 |

The citric acid electrolyte deposits 80-20 wt % gold-tin alloy of semi bright appearance. The current density was 10 ASF and temperature 140° F.

Example 2

| | |
|---|---|
| Ascorbic acid | 100 g/l |
| Tin (as tin sulfate) | 3 g/l |
| Gold (as potassium gold cyanide) | 13 g/l |
| Ethoxylated phenol ester | 0.15 ml/l |
| pH adjusted with KOH | 4 |

The ascorbic acid electrolyte deposits 80-20 wt % gold-tin alloy of semi bright appearance. The current density was 10 ASF and temperature 120° F.

Example 3

| | |
|---|---|
| Potassium malonate | 100 g/l |
| Tin (as tin sulfate) | 1 g/l |
| Gold (as potassium gold cyanide) | 6 g/l |
| Ethoxylated phenol ester | 0.35 ml/l |
| Ascorbic acid | 2 g/l |
| pH adjusted with KOH | 4 |

The potassium malonate electrolyte deposits 80-20 wt % gold-tin alloy of semi bright appearance. The current density was 10 ASF and temperature 130° F.

Example 4

| | |
|---|---|
| Di-sodium-di-hydrogen pyrophosphate | 100 g/l |
| Tin (as tin sulfate) | 5 g/l |
| Gold (as potassium gold cyanide) | 3 g/l |
| Ethoxylated phenol ester (1% solution) | 0.35 ml/l |
| Ascorbic acid | 2 g/l |
| pH adjusted with KOH | 3.7 |

The pyrophosphate electrolyte deposits 80-20 wt % gold-tin alloy of semi bright appearance. The current density was 7.5 ASF and temperature 130° F.

Example 5

| | |
|---|---|
| Potassium oxalate | 100 g/l |
| Tin (as tin sulfate) | 5 g/l |
| Gold (as potassium gold cyanide) | 5 g/l |
| Ethoxylated phenol ester (1% solution) | 0.30 ml/l |
| Di-sodium Cocoampho-dipropionate | 0.1 ml/l |
| pH | 4 |

The oxalate electrolyte deposits 80-20 wt % gold-tin alloy of bright appearance. The current density was 10 ASF and temperature 140° F.

Example 6

| | |
|---|---|
| Potassium oxalate | 100 g/l |
| Ascorbic acid | 24 g/l |
| Tin (as tin sulfate) | 5 g/l |
| Gold (as potassium gold cyanide) | 3.5 g/l |
| Ethoxylated phenol ester (1% solution) | 0.30 ml/l |
| Di-sodium Cocoampho-dipropionate | 0.1 ml/l |
| pH | 4 |

The oxalate/ascorbate electrolyte deposits 80-20 wt % gold-tin alloy of semi bright appearance. The current density was 5 ASF and temperature 130° F.

Example 7

| | |
|---|---|
| Potassium oxalate | 100 g/l |
| Tin (as tin sulfate) | 3.5 g/l |
| Gold (as potassium gold cyanide) | 5 g/l |
| Ethoxylated phenol ester (1% solution) | 0.3 ml/l |
| Di-sodium cocoampho-dipropionate | 0.1 g/l |
| Potassium hexacyanoferrate | 0.3 g/l |
| Ascorbic acid | 0.5 g/l |
| pH | 4 |

The current density was 5 ASF and temperature 130° F. The 80-20 gold-tin alloy deposit was of bright appearance.

While the invention has been described and pointed out in detail with reference to operative embodiments thereof, it will be understood by those skilled in the art that various changes, modifications, substitutions, and omissions can be made without departing from the spirit of the invention. It is intended therefore, that the invention embrace those equivalents within the scope of the claims that follow.

What is claimed is:

1. A solution for use in connection with depositing of a eutectic gold-tin alloy on an electrically conductive substrate, the solution consisting essentially of: water, complexed gold ions, tin ions, a complexing compound to render the tin ions soluble in the solution, an alloy stabilization agent present in an amount sufficient to stabilize the eutectic gold-tin alloy that is deposited and to enable the eutectic gold-tin alloy to be provided over a usable current density range, wherein the solution has a pH of between about 3 and 5.5 and the gold ions and tin ions are present in relative amounts sufficient to ensure that the eutectic gold-tin alloy that is deposited has a gold content of between 75 and 85% by weight and a tin content of between 15 and 25% by weight, and, optionally, at least one of an anti-oxidation compound or a brightening agent; wherein the alloy stabilization agent is an anionic surfactant based on phosphate esters of general structural formula:

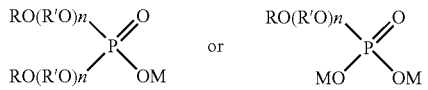

wherein R is alkyl or alkyl aryl group; n is 7 to 10 moles of ethylene and/or propylene oxide; M is hydrogen, sodium, potassium or other counter ion; and R' is ethyl and/or propyl group and the alloy stabilization agent contributes to brightening of the deposit.

2. The solution of claim 1 wherein the complexed gold ions are present as a mono-valent gold cyanide complex, a tri-valent gold cyanide complex or a gold sulfite complex.

3. The solution of claim 1 wherein the tin ions are present in a divalent oxidation state, a tetravalent oxidation state, or a combination thereof.

4. The solution of claim 1 wherein the complexing compound for the tin ions is a solution soluble oxalate, citrate, tartrate, glycerate, ascorbate, gluconate, heptagluconate, malonate, iminodiacetate, nitrilotriacetate, ethylene di-amino-tetra acetate or pyrophosphate.

5. The solution of claim 1 wherein the anti-oxidation compound is catechol, hydroquinone, phenolsulfonic acid, potassium ferro-hexacyanide, hydrazine, hydroxylamine, pyrogallol, tiron, cresolsulphonic acid, pyrocatechol, resorcinol, phloroglucinol, 2-aminodiphenylmethane or p-hydroxyanisole.

6. The solution of claim 1 wherein the complexed gold ions are present in amount between about 0.1 and 100 g/l.

7. The solutions of claim 1 wherein the tin ions are present in the amount between about 0.1 and 50 g/l.

8. The solution of claim 1 wherein the complexing compound for the tin ions is present in the solution from about 5 g/l to about saturation.

9. The solution of claim 1 wherein at least one of the anti-oxidation compound or the brightening agent is present.

10. The solution of claim 9 wherein the anti-oxidation compound is present in an amount of about 0.005 to about 20 g/l.

11. The solution of claim 9 wherein the brightening agent is an amphoteric wetting agent of general structural formula:

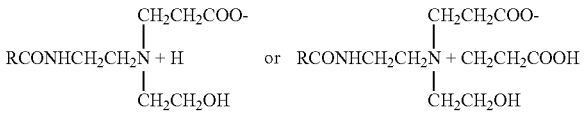

wherein R is fatty acid alkyl group.

12. The solution of claim 11 wherein the brightening agent is sodium coco-di-propionate and is present in a concentration of about of 0.05 to 5 gram per liter.

13. The solution of claim 11 wherein the alloy stabilization agent is present in a concentration of about 0.1 to 10 grams per liter and the brightening agent is present in a concentration of about 0.05 to 5 grams per liter.

14. The solution of claim 1, wherein the solution has a pH of between about 3 and 4.7.

15. A method for electroplating a eutectic gold-tin alloy deposit on a composite article that includes electroplatable and non-electroplatable portions which comprises contacting said article with the solution of claim 1 and passing a current from an insoluble anode through the solution to provide the eutectic gold-tin alloy deposit on the electroplatable portions of said article without deleteriously affecting the non-electroplatable portions of the article, wherein the deposit has a gold content of between 75 and 85% by weight and a tin content of between 15 and 25% by weight.

16. A method for electroplating of a eutectic gold-tin alloy deposit on a substrate which comprises contacting the substrate with the solution of claim 1 and passing a current from an insoluble anode through the solution to provide the gold-tin alloy deposit thereon.

17. A solution for use in connection with depositing of a eutectic gold-tin alloy on an electrically conductive substrate, the solution consisting of water, complexed gold ions, tin ions, a complexing compound to render the tin ions soluble in the solution, and an alloy stabilization agent present in an amount sufficient to stabilize the eutectic gold-tin alloy that is deposited and to enable the eutectic gold-tin alloy to be provided over a usable current density range, wherein the solution has a pH of between about 3 and 5.5 and the gold ions and tin ions are present in relative amounts sufficient to ensure that the eutectic gold-tin alloy that is deposited has a gold content of between 75 and 85% by weight and a tin content of between 15 and 25% by weight and, optionally, at least one of an anti-oxidation compound or a brightening agent, wherein the alloy stabilization agent is an anionic surfactant based on phosphate esters of general structural formula:

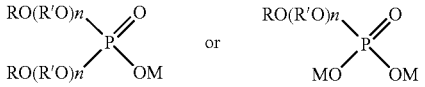

wherein R is alkyl or alkyl aryl group; n is 7 to 10 moles of ethylene and/or propylene oxide; M is hydrogen, sodium, potassium or other counter ion; and R' is ethyl and/or propyl group; and wherein the brightening agent is an amphoteric wetting agent of general structural formula:

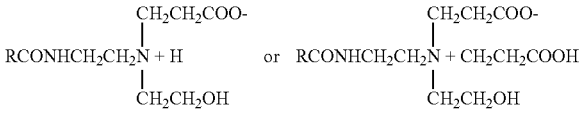

wherein R is fatty acid alkyl group.

18. The solution of claim 17 wherein the anionic surfactant is poly(oxy-1,2-ethanediyl) α-tridecyl ω-hydroxy phosphate in a concentration of 0.1 to 10 grams per liter.

19. A method for electroplating of a eutectic gold-tin alloy deposit on a substrate which comprises contacting the substrate with the solution of claim 17 and passing a current from an insoluble anode through the solution to provide the eutectic gold-tin alloy deposit thereon.

20. A method for electroplating a eutectic gold-tin alloy deposit on a composite article that includes electroplatable and non-electroplatable portions which comprises contacting said article with the solution of claim 17 and passing a current from an insoluble anode through the solution to provide the eutectic gold-tin alloy deposit on the electroplatable portions of said article without deleteriously affecting the non-electroplatable portions of the article.

21. The solution of claim 17 wherein the solution has a pH of between about 3 and 4.7.

22. A method for electroplating of a eutectic gold-tin alloy deposit on a substrate which comprises contacting the substrate with a solution comprising water, complexed gold ions and tin ions, a complexing compound to render the tin ions soluble in the solution, and an alloy stabilization agent present in an amount sufficient to stabilize the eutectic gold-tin alloy that is deposited and to enable the eutectic gold-tin alloy deposit to be provided over a usable current density range, wherein the solution has a pH of between about 3 and 5.5 and the gold ions and tin ions are present in relative amounts sufficient to ensure that the eutectic alloy of gold and tin that is deposited has a gold content of between 75 and 85% by weight and a tin content of between 15 and 25% by weight; wherein the alloy stabilization agent is an anionic surfactant based on phosphate esters of general structural formula:

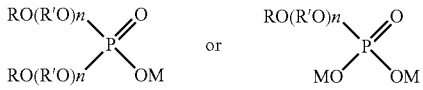

wherein R is alkyl or alkyl aryl group; n is 7 to 10 moles of ethylene and/or propylene oxide; M is hydrogen, sodium, potassium or other counter ion; and R' is ethyl and/or propyl group and the alloy stabilization agent contributes to brightening of the deposit; and passing a current from an insoluble anode through the solution to provide the eutectic gold-tin alloy deposit thereon.

* * * * *